US006287655B1

(12) United States Patent
Nichols, Jr.

(10) Patent No.: US 6,287,655 B1
(45) Date of Patent: Sep. 11, 2001

(54) REMOVABLE FLAT BACK REMOVABLE STICK UP VASE AND METHOD

(76) Inventor: Ernest Nichols, Jr., 5100 Equestrian Way, Antioch, CA (US) 94509

( * ) Notice: Subject to any disclaimer, the term of this patent is extended or adjusted under 35 U.S.C. 154(b) by 0 days.

(21) Appl. No.: 09/335,064

(22) Filed: Jun. 17, 1999

Related U.S. Application Data

(60) Provisional application No. 60/090,396, filed on Jun. 23, 1998.

(51) Int. Cl.[7] ..... B65D 85/50

(52) U.S. Cl. ..... 428/35.7; 428/36.9; 428/36.91; 428/41.7; 47/41.15; 47/66.7; 206/423; 220/9.4; 220/23.9; 220/480; 156/66

(58) Field of Search ..... 428/36.9, 36.91, 428/36.92, 35.7, 41.7, 41.8; 47/66.7, 67, 72, 41.13, 41.15; 206/423; 220/9.4, 23.9, 476, 480, 481, 482, 483; 156/66

(56) References Cited

U.S. PATENT DOCUMENTS 2,642,038 * 6/1953 Howling et al. ..... 220/482
3,632,029 * 1/1972 Sonner ..... 224/275
4,260,086 * 4/1981 Hine, Jr. et al. ..... 224/438
4,708,243 * 11/1987 Nailon ..... 206/315.11
4,828,209 * 5/1989 Niemi ..... 248/222.2
5,381,922 * 1/1995 Gladman et al. ..... 220/481
5,662,973 * 9/1997 Weder ..... 428/36.9
5,683,019 * 11/1997 Schaber ..... 224/191
5,947,322 * 9/1999 Ho ..... 220/447

* cited by examiner

*Primary Examiner*—Rena L. Dye
(74) *Attorney, Agent, or Firm*—Charles L. Thoeming

(57) ABSTRACT

An improved, removable adhesive hook and loop wall mount floral vase. The improved wall mount vase is principally intended for holding one or more buds or a bouquet of flowers, and comprises a vinyl outer body having a predetermined body shape, a predetermined diameter, a predetermined height, and a predetermined thickness. The preferred embodiment of the present invention further comprises a polyvinyl chloride ridged inner body of a predetermined width, height and thickness. The improved vase further comprises an adhesive hook and loop fastener means attached to the outer flat back-side wall of the vinyl vase, for easily mounting the vase onto a flat surface without use of metal fasteners or permanent bonding materials. The removable adhesive hook and loop fastener allows the removal of the vase for cleaning and refilling with water and floral arrangements. The adhesive fastener can be warmed and removed from walls and other flat surfaces with out damaging the surface. The vinyl vase walls of the preferred embodiment are soft. The ridged inner body of the preferred embodiment is installed inside the soft vinyl vase body to give the vase its flat back shape, and firm front body.

5 Claims, 1 Drawing Sheet

REMOVABLE FLAT BACK REMOVABLE STICK UP VASE AND METHOD

CROSS-REFERENCES TO RELATED APPLICATIONS

Applicant claims the benefit of his provisional patent application serial No. 60/090,396 filed Jun. 23, 1998.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

Field of the Invention

The invention relates to a removable adhesive hook and loop wall mounted vase. Description of the Related Art including Information Disclosed under 37 C.F.R. 1.97 and 1.98

A search of the prior art located the following United States patent which is believed to be representative of the present state of the prior art: U.S. Pat. No. 5,662,973, issued Sep. 2, 1997.

BRIEF SUMMARY OF THE INVENTION

The prior art U.S. Pat. No. 5,662,973, dated Sep. 2, 1997, shows a bud vase permanently mounted directly to a flat surface.

There is a need for a wall mounted vase which can hold a bouquet of flowers.

There is a need for a removable wall mounted vase which can be mounted without common metal fasteners or permanent adhesive means, either of which damage the wall surface when removed.

The object of the present invention is to provide: (i) an improved non-wall damaging wall mounted floral vase; (ii) an adhesive hook and loop fastener means for hanging a floral vase; (iii) a decorative removable vinyl wall mounted vase which can be removed without damaging the wall surface; and (iv) a decorative removable vinyl wall mounted vase which can hold a bouquet of fresh or artificial flowers.

Other features, advantages, and objects of the present invention will become apparent with reference to the following description and accompanying drawings.

DETAILED DESCRIPTION OF THE INVENTION

The present invention comprises an improved flat back removable stick up vase. This improved vase further comprises a vinyl outer body having: (i) a defined cross-sectional geometric shape; (ii) a predetermined diameter or width; (iii) a predetermined height; and (iv) thickness, and further comprises a polyvinyl chloride ridged inner body of a predetermined width, height and thickness, and corresponding cross-sectional geometric shape. The improved flat back removable stick up vase of the present invention further comprises an adhesive hook and loop fastener attached to the outer back side walls of the vinyl vase, for mounting the vase onto a flat surface without using metal fasteners or permanent bonding materials. The removable adhesive hook and loop fastener of the present invention allows temporary removal of the vase from the mounting surface for cleaning or refilling with water or refreshing various floral arrangements. The adhesive fastener can be warmed and removed from the predetermined flat mounting surfaces without damage to the surface. The vase wall is constructed of a soft, pliable vinyl material. The ridged inner body mentioned above is constructed of a stiff polyvinyl chloride material which is installed inside the soft vinyl vase body walls to shape the vase to conform to the predetermined, defined cross sectional geometric shape, or into any of the alternate embodiment geometric shapes which have flat backs. The preferred embodiment of the present invention depicted in FIGS. 4 and 5 has a semi-circular cross-sectional geometric shape for both the ridged inner body and the resulting vase body. This cross-sectional geometric shape, however, can easily be modified by inserting a semi-oval ridged inner body shape of a correspondingly predetermined sizing. For vases using the present invention without the wall mounting means or ridged inner body 23, the cross-sectional geometric shape of the vase body also can be circular as depicted in FIG. 6, or oval.

Figure 3:
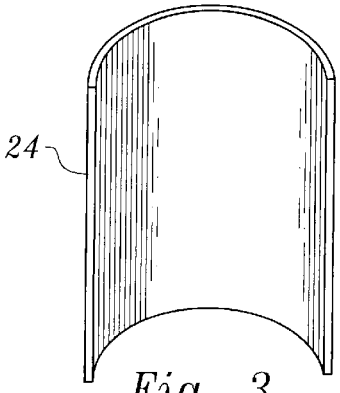
FIG. 3 is a perspective view of the ridged inner body for the vase formed in accordance with the present invention.
Figure 4:
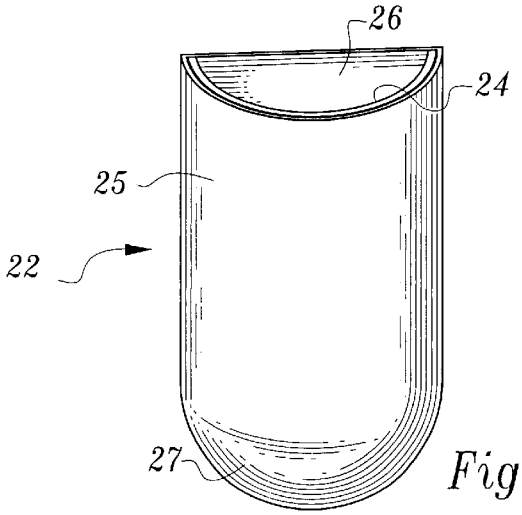
FIG. 4 is a perspective view of a vase formed in accordance with the present invention with ridged inner body in place.
Figure 5:
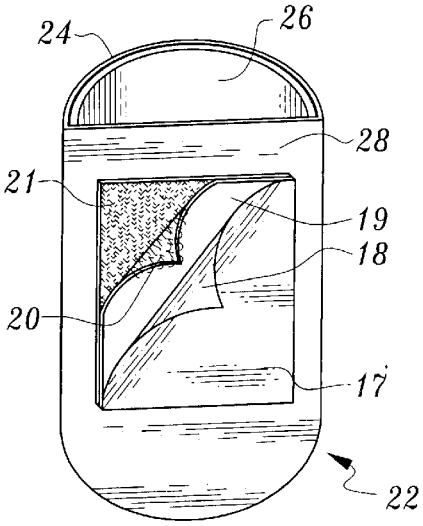
FIG. 5 is a perspective view of the flat back of a vase formed in accordance with the present invention with ridged inner body in place and showing the adhesive fastening means.
Figure 6:
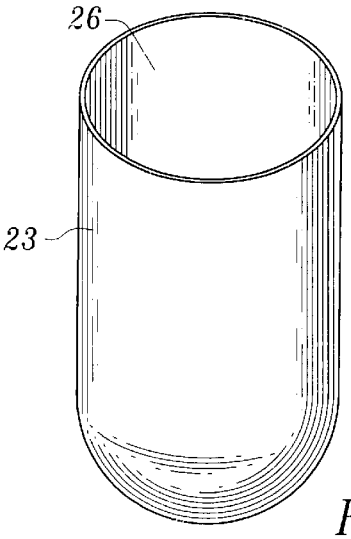
FIG. 6 is a perspective view of a vase formed in accordance with another embodiment of the present invention.

FIGS. 4 and 5 present the preferred embodiment of the present invention for a hook 20 and loop 21 wall mount vase 22 made of vinyl. The vinyl removable floral vase 22 comprises a soft vinyl vase 22 body having a predetermined diameter, height, and thickness. The vase 22 as depicted in this preferred embodiment further comprises a half round polyvinyl chloride ridged inner body 24 [FIG. 3] having a predetermined length, width, thickness. The vinyl vase 22 body takes the semi-circular shape of the semi-circular ridged inner body 24 when said ridged inner body 24 is inserted inside the soft vinyl vase 22 body to give the removable vinyl vase 22 a flat back 28, a solid firm front side 25 body, and a bottom 27. When inserted according to FIGS. 4 and 5, the ridged inner body 24 keeps the vinyl vase 22 walls from collapsing when the vinyl vase is installed at a mounting location. The vase 22 further comprises an adhesive hook 20 and loop 21 fastener means 17 to allow mounting the flat back 28 of the vase to a corresponding flat mounting surface.

The vase 22 of the present invention is constructed using the flowing steps:

1. install polyvinyl chloride ridged inner body 24 inside decorative vinyl vase body 22;
2. install one half of the adhesive fastener 17 to the flat back side 28 of vinyl vase 22;
3. attach the other half of the fastener with protective covering in place to fastener at vase 22;

4. to remove adhesive hook 20 and loop 21 fastener, peel the fastener hook 20 back off the flat mounting surface slowly so as not to damage wall.

The vinyl vase 22 of the present invention is used following the steps below:

1. remove the adhesive protective covering 18, from half of the adhesive hook and loop fastener means 17, exposing the fastener hook's adhesive 19 on the fastener hook 20 and apply the fastener hook's adhesive 19 to the desired location on the flat mounting surface;
2. remove adhesive protective covering 18 from the other side of the adhesive hook and loop fastener means 17, and apply the adhesive portion of the fastener loop 21 to the flat side 28 of the vase 22 which has the ridged inner body 24 installed as discussed above in the steps to construct the vase 22 of the present invention;
3. fill vase 22 with either water and the desired fresh cut floral arrangement or with the desired artificial floral arrangement;
4. vertically install the vase 22 having the fastener loop 21 adhesive pre-attached to the vase 22 back side 28 to the pre-mounted fastener hook 20 at the desired, predetermined flat mounting location, i.e., on windows, on mirrors, on walls, on doors, on the side of vehicles, on the side of boats, and other suitable flat vertical mounting surfaces;
5. to remove adhesive hook 20 and loop 21 fastener, peel the fastener hook 20 back off the flat mounting surface slowly so as not to damage wall.

Figure 1:
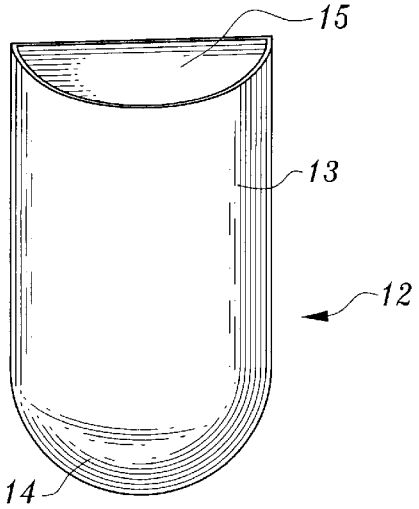
FIG. 1 is a perspective view of a vase formed in accordance with the present invention.
Figure 2:
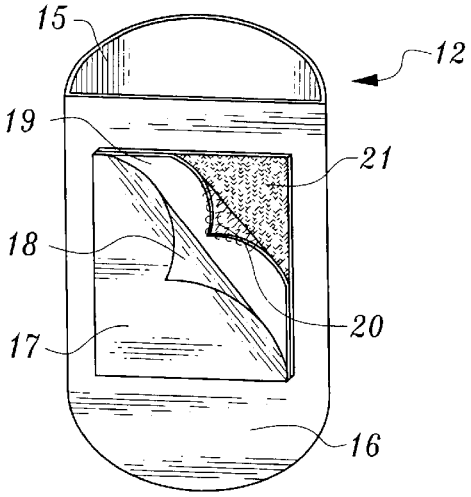
FIG. 2 is a perspective view of the flat back of a vase formed in accordance with the present invention showing the adhesive fastening means.

FIGS. 1 and 2 present another embodiment of the present invention for an improved flat back removable stick up vase 12 showing an adhesive hook 20 and loop 21 fastener means 17 for wall mount vase 12. The wall mount vase comprises a manufactured vase body 12, having a predetermined diameter, height, and thickness, the vase 12 further comprises said an adhesive hook 20 and loop 21 fastener means 17. The decorative vase 12 comprises a flat back 16 side which has a predetermined width, length and thickness to allow the vase 12 to be joined flat against another corresponding flat surface using today's well known self-adhesive hook 20 and loop 21 peel back fastener means 17. Said fastener means allows the vase 12 to be tightly and securely positioned flat against another corresponding flat surface. The hook 20 and loop 21 fastener further comprises hook 20 and loop 21 fasteners, each with an adhesive 19 backing. Each adhesive backing is in turn covered with a protective covering 18. The fastener means 17 loop assembly is attached to the flat back surface 16 of the vase 12. The fastener means hook assembly 20 is attached at desired mounting location. The hook 20 and loop 21 elements of the fastener means 17 will easily separate with force peeling them apart to allow removal of the vase 12 to be cleaned, filled with fresh water, filled with fresh floral arrangements, filled with dry floral arrangements, filled with live plants, or filled with various other decorative contents. The vase 12 further comprises a semi-circular front side surface 13 which has a predetermined width, a predetermined length, and a predetermined thickness. Said front side surface is uniformly connected to the flat back surface 16 on the left and right of the vase 12. The vase 12 further comprises a rounded bottom portion 14 that conforms to the vase's semi-circular front surface 13 and flat back surface 16, and which has a predetermined width, a predetermined length, and a predetermined thickness.

The manufactured vase 12 can be mounted and removed easily from a variety of surfaces including, but not limited to, walls, doors, vehicles, windows, mirrors, sliding doors, glass, outside siding, secondary mounting surfaces, and other suitable flat surfaces.

The embodiment of the present invention depicted by vase 12 can be used by following these steps:

1. remove the adhesive protective covering 18 from the backing of the fastener means 17 exposing the hook adhesive 19 and apply the hook adhesive 19 fastener 17 to the predetermined desired mounting location;
2. remove adhesive protective covering 18 from the loop faster 21 of the fastener means 17 and apply the loop adhesive 19 to the flat back surface 16 of the vase 12;
3. fill vase 12 either with water and the desired fresh cut floral arrangement, or a desired artificial arrangement;
4. vertically install the vase 12 having the fastener loop 21 pre-attached to the vase 12 flat back surface 16 to the fastener hook 20 at the predetermined mounting location.

The foregoing description of the preferred and alternate embodiments of the present invention are presented for purposes of illustration and description. These embodiments are not intended to be exhaustive or to limit the invention to the precise form disclosed, and many modifications and variations are possible in light of the above teaching without deviating from the spirit and the scope of the invention. The fastener hook portion of the fastener means can be more quickly removed from the mounting surface by warming the fastener means with a common garment iron or hair dryer for a period of 15 to 20 seconds. The embodiments herein described are selected to best explain the principles of the invention and its practical application to thereby enable others skilled in the art to best utilize the invention in its various embodiments and with various modifications as suited to the particular purpose contemplated. It is intended that the scope of the invention be defined by the claims appended hereto.

What is claimed is:

1. A kit for removable flat back stick up vase comprising, in combination:

a pliable vase body having an interior surface and an exterior surface, said vase surfaces further comprising a front, a flat back, a bottom, and defining a top opening, wherein said vase body is of a predetermined uniform thickness and of a predetermined height, wherein a predetermined geometric shape is defined by a cross-sectional plane of said vase body taken parallel to said top opening, and wherein said interior surface defines a predetermined volume accessible through said top opening, means for adding support and shape to said vase body comprising a rigid inner body of a predetermined height matching that of the vase body, a predetermined, uniform thickness, and a predetermined geometric shape matching said vase geometric shape defined by said vase cross-section plane of said vase body taken parallel to said vase open top, wherein said rigid inner body cross-section geometric shape is smaller than said vase cross-section geometric shape so as to allow insertion of said rigid inner body into said vase through said vase top opening, wherein said rigid inner body contacts only the inner surface of said vase front when inserted into said vase body, and wherein said inner body defines a second predetermined volume slightly smaller than said vase predetermined volume, and separable attachment means affixed to said flat back surface of said exterior surface of said vase body to allow said vase body to be vertically attached to a predetermined flat mounting surface.

2. The kit of claim 1 wherein said separable attachment means further comprises a hook fastener part and a loop fastener part, said fastener part further comprising an adhesive backing and a removable protective covering over said adhesive backing, and wherein said loop fastener part is adhesively attached to said vase flat back surface and said hook fastener part is adhesively attached to said predetermined flat mounting surface.

3. The kit of claim 2 wherein said predetermined geometric shape is a semi-circle.

4. The kit of claim 2 wherein said predetermined geometric shape is a semi-oval.

5. A method of using a removable flat back stick up vase of claim 2 comprising the following steps:

inserting said rigid inner body into said vase interior through said vase top opening by arranging said rigid inner body face against said vase front inner surface, removing the adhesive protective covering from said hook fastener part, applying the adhesive backing of said hook fastener part to the desired location on said predetermined flat mounting surface, removing the adhesive protective covering from said loop fastener part, applying the adhesive backing of said loop fastener part to said flat back vase surface, filling said vase volume with desired material, and vertically installing said vase by connecting said loop fastener part and said hook fastener part, using said vertically mounted vase as desired, detaching said vase from said vertical mounting by disconnecting said loop fastener part and said hook fastener part once said vase use is completed, and removing said hook fastener part from said predetermined flat mounting surface using moderate external heat source.

* * * * *